US006610108B2

(12) United States Patent
Perry et al.

(10) Patent No.: US 6,610,108 B2
(45) Date of Patent: Aug. 26, 2003

(54) VAPOR PHASE SILOXANE DRY CLEANING PROCESS

(75) Inventors: Robert J. Perry, Niskayuna, NY (US); Patricia A. Hubbard, West Sand Lake, NY (US)

(73) Assignee: General Electric Company, Pittsfield, MA (US)

( * ) Notice: Subject to any disclaimer, the term of this patent is extended or adjusted under 35 U.S.C. 154(b) by 351 days.

(21) Appl. No.: 09/813,666

(22) Filed: Mar. 21, 2001

(65) Prior Publication Data

US 2003/0019048 A1 Jan. 30, 2003

(51) Int. Cl.[7] ..... D06B 1/02

(52) U.S. Cl. ..... 8/142; 510/276; 510/285; 510/466; 8/149.2

(58) Field of Search ..... 510/285, 466, 510/276; 8/142, 149.2

(56) References Cited

U.S. PATENT DOCUMENTS

| | | | | |
|---|---|---|---|---|
| 4,005,231 | A | 1/1977 | Smith | |
| 4,065,258 | A | 12/1977 | France | |
| 4,685,930 | A | 8/1987 | Kasprzak | 8/139.1 |
| 4,911,853 | A | 3/1990 | Coffindaffer et al. | |
| 5,676,705 | A | 10/1997 | Jureller et al. | 8/142 |
| 5,741,365 | A | 4/1998 | Inada et al. | |
| 5,741,367 | A | 4/1998 | Inada et al. | |
| 5,769,962 | A | 6/1998 | Inada et al. | |
| 5,772,781 | A | 6/1998 | Inada et al. | |
| 5,789,359 | A | 8/1998 | Shimozawa et al. | |
| 5,823,210 | A | 10/1998 | Inada et al. | |
| 5,833,761 | A | 11/1998 | Inada et al. | 134/10 |
| 5,834,416 | A | 11/1998 | Morgan et al. | 510/411 |
| 5,865,852 | A | 2/1999 | Berndt | |
| 5,888,312 | A | 3/1999 | Inada et al. | |
| 5,942,007 | A * | 8/1999 | Berndt et al. | 8/142 |
| 5,977,040 | A | 11/1999 | Inada et al. | |
| 5,985,810 | A | 11/1999 | Inada et al. | |
| 6,042,617 | A | 3/2000 | Berndt | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,063,135 | A | 5/2000 | Berndt et al. | |
| 6,200,352 | B1 * | 3/2001 | Romack et al. | 8/142 |
| 2002/0004953 | A1 * | 1/2002 | Perry et al. | 8/142 |

FOREIGN PATENT DOCUMENTS

| | | |
|---|---|---|
| EP | 1 092 803 A | 4/2001 |
| JP | 06327888 | 11/1994 |
| JP | 09299687 | 11/1997 |
| WO | WO 94/01510 | 1/1994 |
| WO | WO 99/10587 | 3/1999 |

OTHER PUBLICATIONS

Database WPI; Section Ch, Week 197826, Derwent Publications Ltd., London, GB; Class A26, AN 1978–46701A, XP002206086 & JP 53 056203 A (Lion Fat & Oil Co Ltd), May 22, 1978 abstract.

Database WPI; Section Ch, Week 199439, Derwent Publications Ltd., London, GB; Class A97, AN 1994–312983, XP002206053 & JP 06 238244 A (Japan Field KK), Aug. 30, 1994 abstract.

Database WPI; Section Ch, Week 199608, Derwent Publications Ltd., London, GB; Class M12, AN 1996–073089, XP002206–54 & JP 07 328563 A (Olympus Optical Co Ltd), Dec. 19, 1995 abstract.

Database WPI; Section Ch, Week 199416, Derwent Publications Ltd., London, GB; Class L03, AN 1994–132722, XP002206055 & JP 06 032795 B (Japan Field KK), May 2, 1994 abstract.

Database WPI; Section Ch, Week 199439, Derwent Publications Ltd., London, GB; Class A97, AN 1994–312982, XP002206056 & JP 06 238243 A (Japan Field KK), Aug. 30, 1994 abstract.

* cited by examiner

*Primary Examiner*—Charles Boyer
(74) *Attorney, Agent, or Firm*—Kenneth S. Wheelock

(57) ABSTRACT

The process of the present invention is directed to a dry cleaning process, comprising the use of volatile cyclic, linear or branched siloxanes in the vapor phase for the cleaning of soiled or stained fabrics. The linear or branched siloxanes have the formula:

$$M_{2+y+2z}D_xT_yQ_z$$

wherein

M is $R^1{}_3SiO_{1/2}$; D is $R^2R^3SiO_{2/2}$; T is $R^4SiO_{3/2}$; and Q is $SiO_{4/2}$ $R^1$, $R^2$, $R^3$ and $R^4$ are each independently a monovalent hydrocarbon radical having from one to forty carbon atoms; and x and y are each integers, wherein $0 \leqq x \leqq 10$ and $0 \leqq y \leqq 10$ and $0 \leqq z \leqq 10$. While the cyclic siloxanes have the formula:

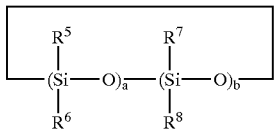

wherein $R^5$, $R^6$, $R^7$ and $R^8$ are each independently a monovalent hydrocarbon group having from one to forty carbon atoms; and a and b are each integers wherein $0 \leqq a \leqq 10$ and $0 \leqq b \leqq 10$, provided that $3 \leqq (a+b) \leqq 10$.

18 Claims, No Drawings

VAPOR PHASE SILOXANE DRY CLEANING PROCESS

TECHNICAL FIELD

The present invention is directed to a dry cleaning process, more specifically, to a siloxane vapor phase based process, for use in dry cleaning.

BACKGROUND

Current dry cleaning technology uses perchloroethylene ("PERC") or petroleum-based materials as the cleaning solvent. PERC suffers from toxicity and odor issues. The petroleum-based products are not as effective as PERC in cleaning garments.

Cyclic siloxanes have been reported as spot cleaning solutions, see U.S. Pat. No. 4,685,930, and as dry cleaning fluids in dry cleaning machines, see U.S. Pat. No. 5,942,007. Other patents disclose the use of silicone soaps in petroleum solvents, see JP 09299687, and the use of silicone surfactants in super critical carbon dioxide solutions has been reported, see, for example, U.S. Pat. No. 5,676,705 and Chem. Mark. Rep., Dec. 15, 1997, 252(24), p. 15. Non-volatile silicone oils have also been used as the cleaning solvent requiring removal by a second washing with perfluoroalkane to remove the silicone oil, see JP 06327888.

Numerous other patents have issued in which siloxanes or organomodified silicones have been present as addenda in PERC or petroleum based dry cleaning solvents, see, for example, WO 9401510; U.S. Pat. No. 4,911,853; U.S. Pat. No. 4,005,231; U.S. Pat. No. 4,065,258.

There is a continued interest in decreasing the need for large quantities of solvents used in dry cleaning processes.

SUMMARY OF THE INVENTION

The process of the present invention is directed to a cleaning process, comprising the use of a volatile cyclic, linear or branched siloxane in the vapor phase for the cleaning of articles.

Further, the present invention provides for a process for cleaning soiled articles of manufacture comprising:

a) contacting the soiled article of manufacture with a vapor phase silicone compound;

b) allowing the vapor phase silicone compound in contact with the soiled article of manufacture to condense to the liquid phase becoming thereby a condensed silicone liquid; and c) draining the condensed silicone liquid away from the article of manufacture whereby the soiled article of manufacture is cleaned.

In another embodiment the present invention provides for a process for cleaning soiled garments comprising:

a) contacting the soiled garment with a vapor phase silicone compound;

b) allowing the vapor phase silicone compound in contact with the soiled garment to condense to the liquid phase becoming thereby a condensed silicone liquid; and c) draining the condensed silicone liquid away from the garment whereby the soiled garment is cleaned.

DETAILED DESCRIPTION OF THE INVENTION

The compounds useful in the practice of the present invention may be linear, branched or cyclic volatile siloxane compounds. In general those siloxanes that are volatile and suitable for use in the practice of the present invention are those siloxanes that are volatile at room temperature, i.e. about 25° C. Volatility is a quantitative measurement at a given temperature and thus broadly defined involves a partial pressure or vapor pressure, i.e. a pressure below 760 mm Hg, at a given temperature. Broadly, volatile siloxanes are those siloxanes that have a vapor pressure or partial pressure (as used herein the two terms are interchangeable) above 0.01 mm Hg at a temperature of 20° C.

Compounds suitable as the linear or branched, volatile siloxane solvent of the present invention are those containing a polysiloxane structure that includes from 2 to 20 silicon atoms. Preferably, the linear or branched, volatile siloxanes are relatively volatile materials, having, for example, a boiling of below about 300° C. point at a pressure of 760 millimeters of mercury ("mm Hg").

In one embodiment, the linear or branched, volatile siloxane comprises one or more compounds of the structural formula (I):

$$M_{2+y+2z}D_xT_yQ_z \quad (I)$$

wherein:

M is $R^1{}_3SiO_{1/2}$;

D is $R^2R^3SiO_{2/2}$;

T is $R^4SiO_{3/2}$;

and Q is $SiO_{4/2}$ $R^1$, $R^2$, $R^3$ and $R^4$ are each independently a monovalent hydrocarbon radical having from one to forty carbon atoms; and x and y are each integers, wherein $0 \leqq x \leqq 10$ and $0 \leqq y \leqq 10$ and $0 \leqq z \leqq 10$.

Suitable monovalent hydrocarbon groups include linear hydrocarbon radicals, branched hydrocarbon radicals, monovalent alicyclic hydrocarbon radicals, monovalent and aromatic or fluoro containing hydrocarbon radicals. Preferred monovalent hydrocarbon radicals are monovalent alkyl radicals, monovalent aryl radicals and monovalent aralkyl radicals.

As used herein, the term "$(C_1–C_6)$alkyl" means a linear or branched alkyl group containing from 1 to 6 carbons per group, such as, for example, methyl, ethyl, propyl, isopropyl, n-butyl, iso-butyl, sec-butyl, tert-butyl, pentyl, hexyl, preferably methyl.

As used herein, the term "aryl" means a monovalent unsaturated hydrocarbon ring system containing one or more aromatic or fluoro containing rings per group, which may optionally be substituted on the one or more aromatic or fluoro containing rings, preferably with one or more $(C_1–C_6)$ alkyl groups and which, in the case of two or more rings, may be fused rings, including, for example, phenyl, 2,4,6-trimethylphenyl, 2-isopropylmethylphenyl, 1-pentalenyl, naphthyl, anthryl, preferably phenyl.

As used herein, the term "aralkyl" means an aryl derivative of an alkyl group, preferably a $(C_2–C_6)$alkyl group, wherein the alkyl portion of the aryl derivative may, optionally, be interrupted by an oxygen atom, such as, for example, phenylethyl, phenylpropyl, 2-(1-naphthyl)ethyl, preferably phenylpropyl, phenyoxypropyl, biphenyloxypropyl.

In another embodiment, the monovalent hydrocarbon radical is a monovalent $(C_1–C_6)$alkyl radical, most preferably, methyl.

In another embodiment, the linear or branched, volatile siloxane comprises one or more of, hexamethyldisiloxane, octamethyltrisiloxane, decamethyltetrasiloxane, dodecamethylpentasiloxane, tetradecamethylhexasiloxane or hexadecamethylheptasiloxane or methyltris (trimethylsiloxy)silane. In a more highly preferred embodiment, the linear or branched, volatile siloxane of the present invention comprises octamethyltrisiloxane, decamethyltetrasiloxane, or dodecamethylpentasiloxane or methyltris(trimethylsiloxy)silane. In a highly preferred embodiment, the siloxane component of the composition of the present invention consists essentially of decamethyltetrasiloxane.

Suitable linear or branched volatile siloxanes are made by known methods, such as, for example, hydrolysis and condensation of one or more of tetrachlorosilane, methyltrichlorosilane, dimethyldichlorosilane, trimethylchlorosilane, or by isolation of the desired fraction of an equilibrate mixture of hexamethyldisiloxane and octamethylcyclotetrasiloxane or the like and are commercially available.

Compounds suitable as the cyclic siloxane component of the present invention are those containing an oligomeric or polysiloxane ring structure that includes from 2 to 20 silicon atoms in the ring. Preferably, the linear, branched and cyclic siloxanes are relatively volatile materials, having, for example, a boiling point of below about 300° C. at a pressure of 760 millimeters of mercury ("mm Hg"). Thus for the purposes of defining a volatile siloxane compound useful in the practice of the process of the present invention a volatile siloxane, whether linear branched or cyclic has a vapor pressure ranging from 0.01 to 760 mm Hg at a temperature ranging from about 10° C. to about 300° C.

In another embodiment, the cyclic siloxane comprises one or more compounds of the structural formula (II):

(II)

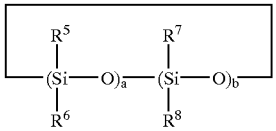

wherein:

$R^5$, $R^6$, $R^7$ and $R^8$ are each independently a monovalent hydrocarbon group having from one to forty carbon atoms; and a and b are each integers wherein $0 \leqq a \leqq 10$ and $0 \leqq b \leqq 10$, provided that $3 \leqq (a+b) \leqq 10$.

In yet another embodiment, the cyclic siloxane comprises one or more of, octamethylcydotetrasiloxane, decamethylcyclopentasiloxane, dodecamethylcyclohexasiloxane, tetradecamethylcycloheptasiloxane. In a more highly preferred embodiment, the cyclic siloxane of the present invention comprises octamethylcyclotetrasiloxane or decamethylcyclopentasiloxane. In yet another embodiment, the cyclic siloxane component of the composition of the present invention consists essentially of decamethylcyclopentasiloxane.

Suitable cyclic siloxanes are made by known methods, such as, for example. Hydrolysis and condensation of alkylhalosilanes, e.g. dimethyldichlorosilane, and are commercially available.

The process of the invention involves generation of a gas phase silicone by a combination of heating the silicone in a solvent reservoir and optionally reducing pressure so as to allow the silicone to vaporize followed by contacting the silicone vapors with the garment to be cleaned. While the formula describing compounds useful in the process of the present invention has already been described, those compounds useful in the practice of the present invention in one embodiment should have vapor pressures between about 3.0 mm Hg and about 760 mm Hg at temperatures ranging from about 20° C. to about 100° C. In a second embodiment those compounds useful in the practice of the present invention should have vapor pressures between about 0.01 mm Hg and about 760 mm Hg at temperatures ranging from about 20° C. to about 270° C. In a third embodiment those compounds useful in the practice of the present invention should have vapor pressures between about 1.0 mm Hg and about 760 mm Hg at temperatures ranging from about 20° C. to about 134° C. In a fourth embodiment those compounds useful in the practice of the present invention should have vapor pressures between about 0.01 mm Hg and about 760 mm Hg at temperatures ranging from about 20° C. to about 264° C.

Alternatively, other methods known in the art can be employed to form vapors of silicones including mechanical means.

The vapors of the compounds of the present invention thus formed, either at atmospheric pressure or at reduced pressure, are allowed to contact the fabric to be cleaned for a specified time wherein these same vapors condense in the fabric, dissolving the soiling material or stain and draining away from the fabric, after which time the articles are removed, cooled as needed, and dried by various methods known in the art such as air drying, heated drying and the like. In one embodiment, the process of the present invention may be performed at a constant pressure. In another embodiment the process of the present invention is performed at a pressure that is varied among the steps of the process, e.g. initially contacting the garment to be cleaned with a vapor at a pressure below atmospheric followed by raising the pressure to atmospheric pressure to condense the vapor in the garment and allow the cleaning fluids to drain away from the garment.

Alternatively, the articles remain in the cleaning vessel and the silicone or silicone containing solvent is removed by various means and the articles are dried in the cleaning vessel as is commonly seen in typical dry cleaning machines.

An article, such as for example, a textile or leather article, typically, a garment, is cleaned by contacting the article with the vapors of the composition of the present invention. In a preferred embodiment, the articles to be cleaned include textiles made from natural fibers, such as for example, cotton, wool, linen and hemp, from synthetic fibers, such as, for example, polyester fibers, polyamide fibers, polypropylene fibers and elastomeric fibers, from blends of natural and synthetic fibers, from natural or synthetic leather or natural or synthetic fur.

The article and dry cleaning composition are then separated, by, for example, one or more of draining and centrifugation. In a preferred embodiment, separation of the article and dry cleaning composition is followed by the application of heat, preferably, heating to a temperature of from 15° C. to 120° C., preferably from 20° C. to 100° C., or reduced pressure, preferably, a pressure of from 1 mm Hg to 750 mm Hg, or by application of both heat and reduced pressure, to the article.

Testing for oil soluble stain removal was accomplished using a blue 50/50 cotton/poly cloth and a red satin fabric. The approximately 2 inch square samples were stained with motor oil, suspended by wires in a large glass vessel equipped with a thermometer, and condensing unit capable of condensing the volatile silicone solvent. The articles were positioned such that the solvent vapors saturated the article but were not contacted by the returning, condensed solvent.

The process of the present invention is not limited to the cleaning of garments or articles of clothing, it may be applied to any article of manufacture contaminated with a silicone soluble contaminant that may be subjected to the process of the present invention wherein the contaminant is dissolved in the silicone compound and drained away, thereby removing the contaminant from the article of manufacture.

The following examples are to illustrate the invention and are not to be construed as limiting the claims.

EXAMPLES

Example 1

Atmospheric Pressure, Cyclic Solvent

Samples of red satin and blue cotton/poly fabrics were treated with motor oil which was allowed to stain for 18 hours then attached to a wire holder and suspended above a reservoir of D5. The solvent was heated to boiling and the vapors allowed to contact the stained fabrics for 5 minutes. After this time, the heat was removed, the vessel cooled and the samples removed and air dried and evaluated. All traces of the oil were removed from both fabrics. There was some extraction of the red dye from the satin fabric.

Example 2

Reduced Pressure, Cyclic Solvent

Samples of red satin and blue cotton/poly fabrics were treated with motor oil which was allowed to stain for 18 hours then attached to a wire holder and suspended above a reservoir of D5. The pressure in the system was reduced to 1–2 mm Hg and the temperature of the solvent reservoir was raised to 70–80° C. The vapors were allowed to contact the stained fabrics for 5 minutes. After this time, the heat was removed, the vessel cooled and the samples removed and air dried and evaluated. All traces of the oil were removed from both fabrics. No extraction of the red dye from the satin fabric was observed.

Example 3

Reduced Pressure, Linear Solvent

Samples of red satin and blue cotton/poly fabrics were treated with motor oil which was allowed to stain for 18 hours then attached to a wire holder and suspended above a reservoir of MD2M. The pressure in the system was reduced to 1–2 mm Hg and the temperature of the solvent reservoir was raised to 70–80° C. The vapors were allowed to contact the stained fabrics for 5 minutes. After this time, the heat was removed, the vessel cooled and the samples removed and air dried and evaluated. All traces of the oil were removed from both fabrics. No extraction of the red dye from the satin fabric was observed.

Having described the invention, that which is claimed is:

1. A process for cleaning soiled garments comprising:

a) contacting the soiled garment with a vapor wherein said vapor consists essentially of a vapor phase silicone compound;

b) allowing the vapor phase silicone compound in contact with the soiled garment to condense to the liquid phase becoming thereby a condensed silicone liquid; and c) draining the condensed silicone liquid away from the garment whereby the soiled garment is cleaned.

2. The process of claim 1 wherein the silicone compound has the formula:

$$M_{2+y+2z}D_xT_yQ_z$$

wherein:

M is $R^1{}_3SiO_{1/2}$;

D is $R^2R^3SiO_{2/2}$;

T is $R^4SiO_{3/2}$;

and Q is $SiO_{4/2}$ $R^1$, $R^2$, $R^3$ and $R^4$ are each independently a monovalent hydrocarbon radical having from one to forty carbon atoms; and x and y are each integers, wherein $0 \leqq x \leqq 10$ and $0 \leqq y \leqq 10$ and $0 \leqq z \leqq 10$.

3. The process of claim 1 wherein the silicone compound has the formula:

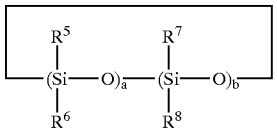

wherein:

$R^5$, $R^6$, $R^7$ and $R^8$ are each independently a monovalent hydrocarbon group having from one to forty carbon atoms; and a and b are each integers wherein $0 \leqq a \leqq 10$ and $0 \leqq b \leqq 10$, provided that $3 \leqq (a+b) \leqq 10$.

4. The process of claim 2 wherein each of the steps a), b) and c) are independently conducted at a temperature ranging from about 10° C. to about 300° C.

5. The process of claim 3 wherein each of the steps a), b) and c) are independently conducted at a temperature ranging from about 10° C. to about 300° C.

6. The process of claim 4 wherein each of the steps a), b) and c) are independently conducted at a pressure ranging from about 0.01 mm Hg to about 760 mm Hg.

7. The process of claim 5 wherein each of the steps a), b) and c) are independently conducted at a pressure ranging from about 0.01 mm Hg to about 760 mm Hg.

8. The process of claim 6 wherein the silicone compound is selected from the group consisting of hexamethyldisiloxane, octamethyltrisiloxane, decamethyltetrasiloxane, dodecamethylpentasiloxane, tetradecamethylhexasiloxane, hexadecamethylheptasiloxane and methyltris(trimethylsiloxy)silane.

9. The process of claim 7 wherein the silicone compound is selected from the group consisting of hexamethyldisiloxane, octamethyltrisiloxane, decamethyltetrasiloxane, dodecamethylpentasiloxane, tetradecamethylhexasiloxane, hexadecamethylheptasiloxane and methyltris(trimethylsiloxy)silane.

10. A process for cleaning soiled garments consisting essentially of:

a) contacting the soiled garment with a vapor wherein said vapor consists essentially of a vapor phase silicone compound;

b) allowing the vapor phase silicone compound in contact with the soiled garment to condense to the liquid phase becoming thereby a condensed silicone liquid; and c) draining the condensed silicone liquid away from the garment whereby the soiled garment is cleaned.

11. The process of claim 10 wherein the silicone compound has the formula:

$$M_{2+y+2z}D_xT_yQ_z$$

wherein:

M is $R^1{}_3SiO_{1/2}$;

D is $R^2R^3SiO_{2/2}$;

T is $R^4SiO_{3/2}$;

and Q is $SiO_{4/2}$ $R^1$, $R^2$, $R^3$ and $R^4$ are each independently a monovalent hydrocarbon radical having from one to forty carbon atoms; and x and y are each integers, wherein $0 \leqq x \leqq 10$ and $0 \leqq y \leqq 10$ and $0 \leqq z \leqq 10$.

12. The process of claim 10 wherein the silicone compound has the formula:

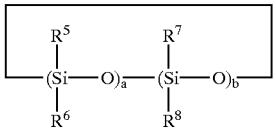

wherein:

$R^5$, $R^6$, $R^7$ and $R^8$ are each independently a monovalent hydrocarbon group having from one to forty carbon atoms; and a and b are each integers wherein $0 \leqq a \leqq 10$ and $0 \leqq b \leqq 10$, provided that $3 \leqq (a+b) \leqq 10$.

13. The process of claim 11 wherein each of the steps a), b) and c) are independently conducted at a temperature ranging from about 10° C. to about 300° C.

14. The process of claim 12 wherein each of the steps a), b) and c) are independently conducted at a temperature ranging from about 10° C. to about 300° C.

15. The process of claim 13 wherein each of the steps a), b) and c) are independently conducted at a pressure ranging from about 0.01 mm Hg to about 760 mm Hg.

16. The process of claim 14 wherein each of the steps a), b) and c) are independently conducted at a pressure ranging from about 0.01 mm Hg to about 760 mm Hg.

17. The process of claim 15 wherein the silicone compound is selected from the group consisting of hexamethyldisiloxane, octamethyltrisiloxane, decamethyltetrasiloxane, dodecamethylpentasiloxane, tetradecamethylhexasiloxane, hexadecamethylheptasiloxane and methyltris(trimethylsiloxy)silane.

18. The process of claim 16 wherein the silicone compound is selected from the group consisting of hexamethyldisiloxane, octamethyltrisiloxane, decamethyltetrasiloxane, dodecamethylpentasiloxane, tetradecamethylhexasiloxane, hexadecamethylheptasiloxane and methyltris(trimethylsiloxy)silane.

* * * * *